United States Patent [19]

Whitehead et al.

[11] Patent Number: 4,907,742

[45] Date of Patent: Mar. 13, 1990

[54] IMPULSE SPRINKLER WITH DEFLECTOR

[75] Inventors: Stephen P. Whitehead, Elgin; Michael D. Ferguson, West Chicago, both of Ill.

[73] Assignee: Suncast Corporation, Batavia, Ill.

[21] Appl. No.: 212,779

[22] Filed: Jun. 29, 1988

[51] Int. Cl.[4] ..... B05B 3/08

[52] U.S. Cl. ..... 239/230; 239/231

[58] Field of Search ..... 239/230, 231, 233, 275, 239/396, 505, 507, 509, 510, 513, 518, 521, 523; 267/275, 155; 248/297.3; 403/104

[56] References Cited

U.S. PATENT DOCUMENTS

| | | | |
|---|---|---|---|
| 142,719 | 9/1873 | Nickerson | 239/521 |
| 357,799 | 2/1887 | Wainwright | 239/513 |
| 577,131 | 2/1897 | Goff et al. . | |
| 2,863,657 | 12/1958 | Altherr | 267/275 |
| 3,070,314 | 12/1962 | Warren | 239/230 |
| 3,664,586 | 5/1972 | Harris, Sr. | 239/233 |
| 3,765,608 | 10/1973 | Lockwood | 239/230 |
| 3,837,576 | 9/1974 | Rosenkranz | 239/230 |
| 4,205,788 | 6/1980 | Bruninga | 239/510 X |
| 4,398,666 | 8/1983 | Hunter | 239/222.13 |
| 4,497,441 | 2/1985 | Chow | 239/230 |
| 4,569,485 | 2/1986 | Walto | 239/456 |
| 4,637,549 | 1/1987 | Schwartzman | 239/230 |
| 4,657,425 | 4/1987 | Takahashi | 403/104 |
| 4,787,558 | 11/1988 | Sexton et al. | 239/230 |

FOREIGN PATENT DOCUMENTS

| | | | |
|---|---|---|---|
| 911413 | 11/1962 | United Kingdom | 239/510 |

OTHER PUBLICATIONS

Gilmour Catalog, Lawn and Garden Products, 1983.

*Primary Examiner*—Andres Kashnikow
*Assistant Examiner*—Christopher G. Trainor
*Attorney, Agent, or Firm*—Fitch, Even, Tabin & Flannery

[57] ABSTRACT

An impulse sprinkler includes a base and a main body having a nozzle for dispensing water. The main body also includes a frame defining a window. The main body is pivotably mounted on the base so that the main body can rotate about a vertical axis. The sprinkler further includes an impulse arm for deflection by water dispensed by the nozzle with the impulse arm being pivotably mounted on the main body so that the arm extends through the window and is also rotatable about a vertical axis. A spring is positioned in the window for biasing the impulse arm to a position where it will be deflected by water from the nozzle. The sprinkler also includes an elongate deflector pivotably carried by the main body so that the deflector can rotate about a horizontal axis. This deflector is of one-piece molded construction and has a deflector head overlying the nozzle, a tail for grasping by the user, and an intermediate portion supported by the main body.

5 Claims, 4 Drawing Sheets

IMPULSE SPRINKLER WITH DEFLECTOR

This invention relates to sprinklers and, more particularly, to an impulse sprinkler including a deflector for adjusting the distance of travel of the dispensed water.

BACKGROUND OF THE INVENTION

Rotary impulse sprinklers include a main body which can rotate about a vertical axis. This body pivotally carries an impulse arm which can independently rotate about the vertical axis. Water dispensed by a nozzle held on the main body causes deflection of the arm. A reversing mechanism held by the main body limits the extent of deflection of the arm so that the main body rotates about the vertical axis in a fast step-by-step fashion, for example, through an angle of about 2 degrees as a result of each deflection. The arm is biased into position for deflection by a helical tension spring acting upon both the main body and the impulse arm. Upon the main body reaching a predetermined angular position, a reversing mechanism is actuated which permits the impulse arm to swing through a much greater angular distance with each oscillation resulting in the main body returning toward its predetermined starting position where the reversing mechanism is again switched. This return movement is in a slow step-by-step fashion with the arm returning through an angle of about 5 degrees per deflection. Of course, the reversing mechanism can be disabled resulting in full circle operation in either the fast step mode or the slow step mode, depending on the position of the reversing mechanism.

Such impulse sprinklers commonly are equipped with deflectors carried by the main body overlying the nozzle for limiting the radial excursion of the dispensed water. These deflectors are formed by several separate components and require the use of a tool or both hands of the operator for adjustment. Furthermore, the use of such a deflector results in the diffusion of the water so that the water cannot be accurately limited to the ground area desired to be covered, resulting in overspray.

For example, one such sprinkler includes a deflector block pivotally mounted by pins on the sprinkler main body. The inclination of the block is controlled by a cam surface on a knob acting against one end of the pivotable block. A spring is required to maintain the block end in engagement with the cam surface. For further information concerning the structure and operation of such prior art impulse sprinklers, reference may be made to U.S. Pat. Nos. 4,497,441 and 3,070,314.

SUMMARY OF THE INVENTION

Among the several aspects and features of the present invention may be noted the provision of an improved impulse sprinkler. The sprinkler includes a deflector which is of one-piece construction, does not require the use of a biasing spring, and which can be adjusted without the use of any tool and with only one hand. While limiting the radial distance traveled by the water, the deflector also functions to concentrate the stream to prevent overspray. Furthermore, the impulse arm and the main body of the sprinkler include simplified structure for mounting and retaining the helical tension return spring for the impulse arm. The impulse sprinkler of the present invention is reliable in use, has long service life and is relatively easy and economical to manufacture. Other aspects and features of the present invention will be in part apparent and in part pointed out specifically in the following specification and accompanying drawings.

Briefly, an impulse sprinkler embodying various aspects of the present invention includes a base and a main body having a nozzle and also having a frame defining a window. The main body is pivotably mounted on the base so that the main body can rotate about a substantially vertical axis. The sprinkler further includes an impulse arm for deflection of water dispensed by the nozzle. The impulse arm is pivotably mounted on the main body so that the arm extends through the window and is also rotatable about a vertical axis. A spring is positioned in the window for biasing the impulse arm to a position in which it will be deflected by water from the nozzle. The sprinkler also includes an elongated deflector pivotably carried by the main body so that the deflector can rotate about a horizontal axis. The deflector is one-piece molded thermoplastic construction and includes a deflector head overlying the nozzle, a tail for grasping by the user and an intermediate portion supported by the main body. The deflector is capable of being pivoted through a range of positions between a maximum deflection position in which the head is adjacent to the nozzle and a minimum deflection position in which the head is remote from the nozzle. The main body and the intermediate portion have components which cooperate to hold the deflector in a predetermined one of the positions.

BRIEF DESCRIPTION OF THE DRAWINGS

Corresponding reference numerals indicate corresponding components throughout the several views of the drawings.

DESCRIPTION OF THE PREFERRED EMBODIMENT

Figure 1:
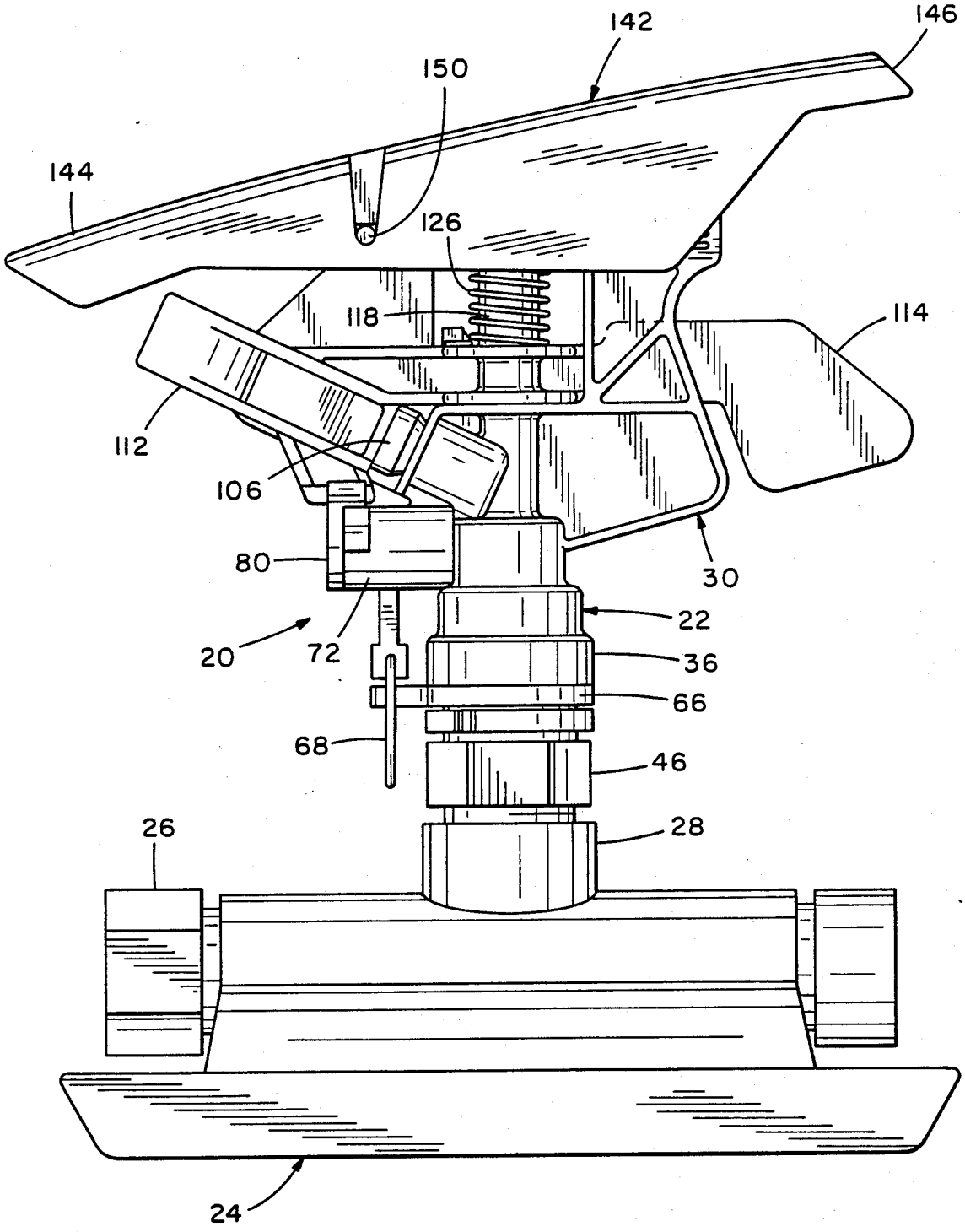
FIG. 1 is a side elevational view of an impulse sprinkler, including a sprinkler head and a base, embodying various aspects of the present invention.

Referring now to the drawings, an impulse sprinkler embodying various features of the present invention is indicated in FIG. 1 by reference number 20. The sprinkler 20 includes a sprinkler head 22, best shown in FIG. 2, and a base 24 which could be of the sled type (as shown) or of the spike type. In either event the base includes a female connector 26 for receiving the male end of a garden hose, a female connector 28 for receiving the sprinkler head, and a fluid channel (not shown) communicating with these connectors for transmitting water from the hose to the sprinkler head.

Figure 2:
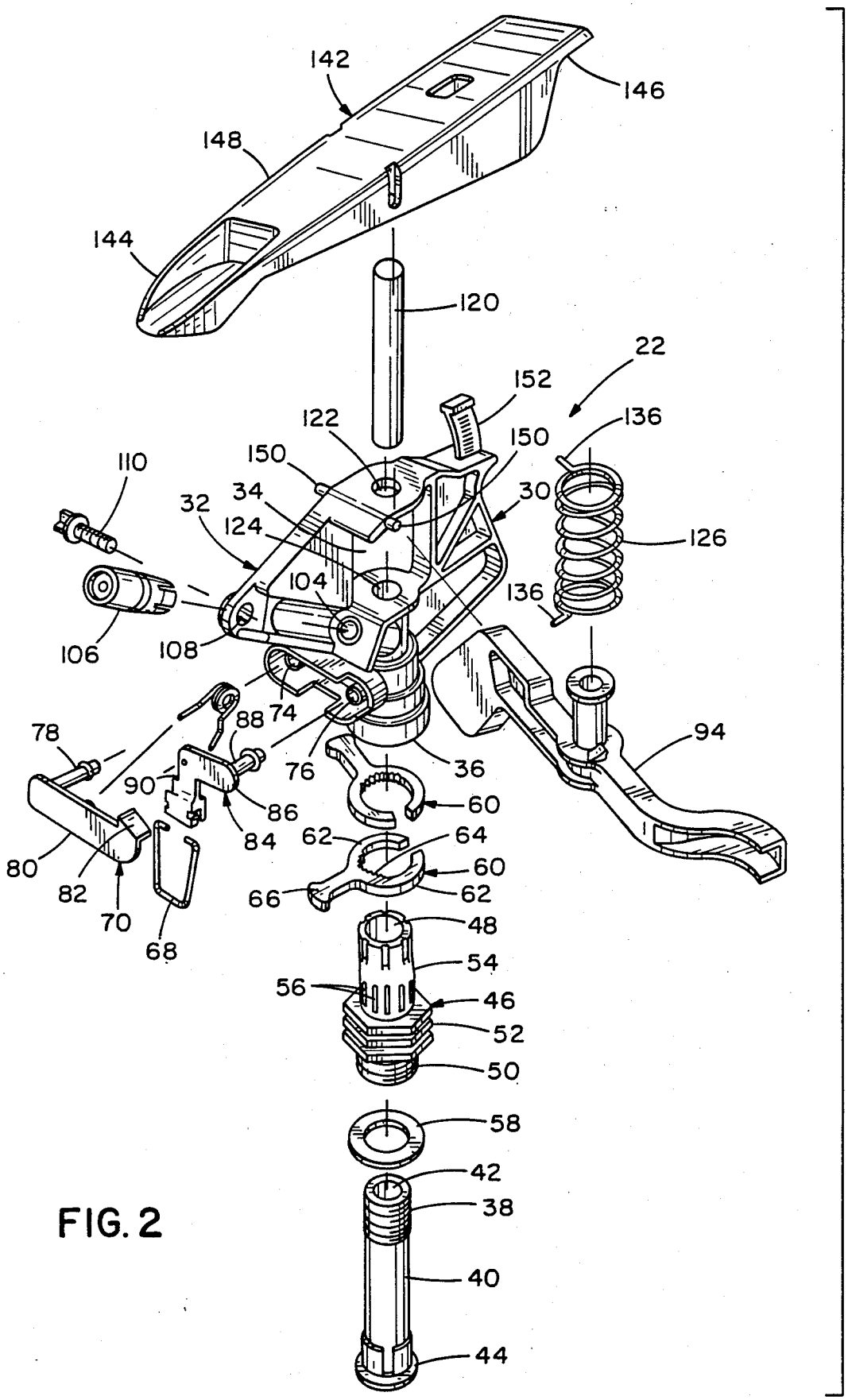
FIG. 2 is an exploded perspective drawing of components forming the sprinkler head including a main body, an impulse arm, a helical torsion spring acting on the arm and body, and a deflector carried by the body.

The sprinkler head 22 is best shown in FIG. 2 and includes a main body 30 including a frame 32 defining a window 34 and a dependent female connector 36 having a thread on its inner surface receiving the threaded upper end 38 of a center post 40 having a bore 42. The post 40 has an enlarged lower end 44 for reception in the female connector 28 of the base. The head 22 also includes means pivotally mounting the main body 30 on the base 24, in the form of a mounting sleeve 46 having a bore 48 sized to slidably receive the upper end 38 and midportion of the center post 40, but of insufficient size to pass the center post lower end 44. The sleeve 46 has a threaded lower end 50 for connection to the base female connector 28, a central portion 52 including flats for engagement by the jaws of pliers to permit tightening of the sleeve onto the base, and an upper extension 54 having a plurality of regularly spaced ribs 56 extending vertically on its outer surface. A sealing O-ring 58 is provided on the center post, and a pair of angle adjustment split rings 60 compressively hold the upper sleeve extension.

Each split ring 50 includes a pair of resiliently deflectable arms 62 and a plurality of teeth 64 on the inner surface of the ring for cooperating with the ribs 56 to retain the ring in a predetermined position. Each ring also has a radially outwardly extending trip finger 66 for engaging and actuating the reversing clip 65 of a reversing mechanism 70 held by the main body 30.

The reversing mechanism 70 includes a housing 72 integral with the main body and including spaced pivot pin receiving apertures 74 and 76. Aperture 74 receives a pivot pin 78 extending from one end of a front plate 80 having at its other end an upwardly extending abutment nose 82. An angled reversing lever 84 includes an upper leg 86 having a rearwardly extending pivot pin 88 received by the other housing aperture 76, and lower leg 90 from which the reversing clip 68 depends. A scissor spring 92 has one end held by the front plate 80 and the other end held by the reversing lever 84. As is apparent to those of skill in the art, the front plate, lever and spring form an overcentering mechanism so that actuation of the clip 68 by one finger 66 results in downward pivoting of the plate 80 to drop the abutment nose 82. Actuation of the reversing clip 68 by the other trip finger 66 causes the plate 80 to pivot upwardly to raise the nose into position for striking by an impulse arm 94.

Figure 3:
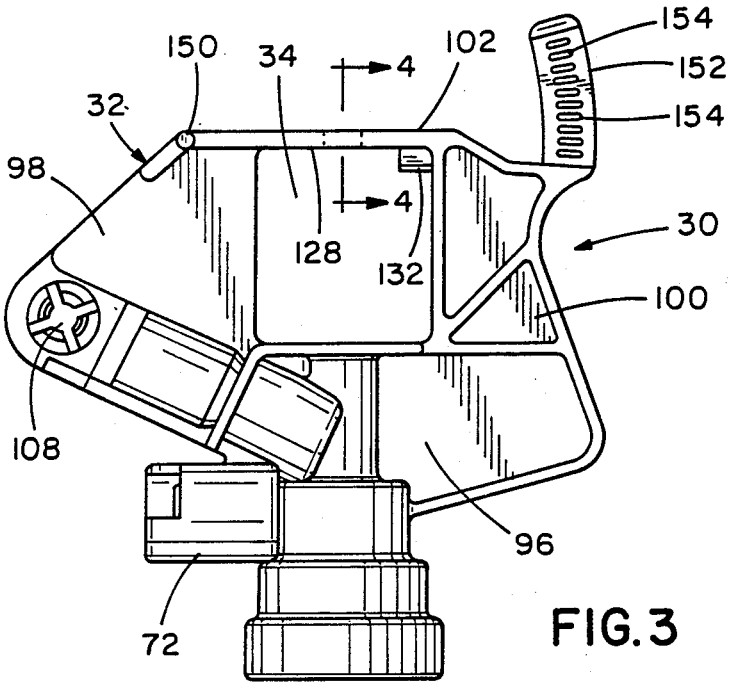
FIG. 3 is a side elevational view of the sprinkler head main body.

Referring to FIG. 3, the frame 32 includes a bottom wall 96, a front wall 98, a rear wall 100, and a top wall 102, with these walls defining the window 34. As shown in FIG. 2, the bottom wall 96 includes an opening 104 receiving a nozzle 106 and an internal channel is provided for conveying water from the female connector 36 to the nozzle. The front wall 98 has an opening 108 for threadably receiving a diffuser screw 110.

Figure 5:
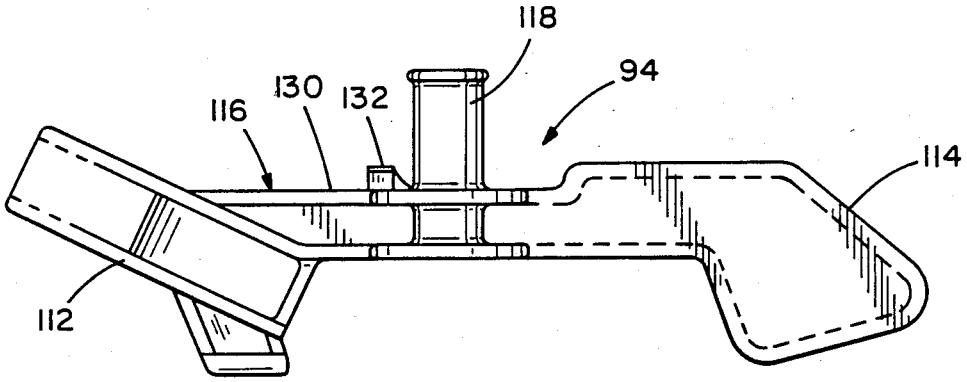
FIG. 5 is a side elevational view of the impulse arm.
Figure 6:
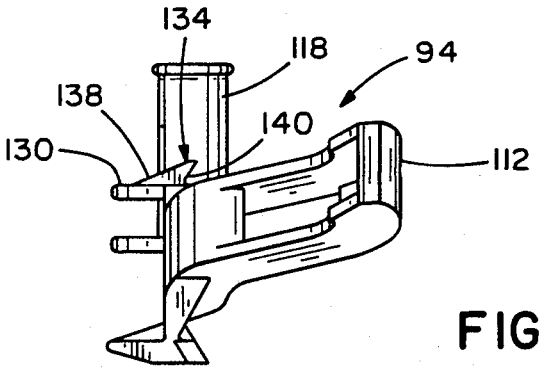
FIG. 6 is a front elevational view of the impulse arm.

The impulse arm 94, best shown in FIGS. 5 and 6, extends through the window 34 and includes a spoon 112 for impingement by the dispensed water, a counterbalance 114, and a central portion 116 including a hub 118 for receiving a pivot pin 120 which is received in an interference fit in aligned holes 122 and 124, in the top wall 102 and bottom wall 96, respectively, thereby pivotally mounting the impulse arm for rotation about a vertical axis. A helical torsion spring 126 biases the impulse arm toward a deflection position in alignment with the nozzle 106.

The operation of an impulse sprinkler is known to those of skill in the art and need not be described in detail here. Suffice to say that with the front plate 80 in its up position so that the abutment nose 82 interferes with the impulse arm 94, the impulse arm undergoes fast oscillatory movement causing the main body 30 to rotate in the counterclockwise direction in about 2 degree steps. When the reversing clip 68 is actuated by one of the trip fingers 66, the front plate 80 is caused to pivot downwardly, dropping the abutment nose 82 beneath the level of the impulse arm 94. The impulse arm is then free to swing through a much greater arc. The impact of the arm on the frame 32 upon being returned due to the influence of the spring 126 causes the main body 30 to rotate in a clockwise direction in about 5 degree steps until the clip 68 is actuated by the trip finger 66 of the other ring 60 to start another cycle of operation.

Figure 4:
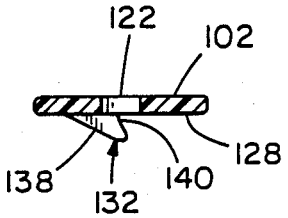
FIG. 4 is a sectional view taken along line 4—4 of FIG. 3.

More specifically, the top wall 102 of the frame has a generally horizontal undersurface 128, and the central portion 116 of the impulse arm 94 has a substantially horizontal facing surface 130. As best shown in FIGS. 3 and 4, a cam stop 132 is positioned on undersurface 128, and (as best shown in FIGS. 5 and 6) a cam stop 134 is positioned on facing surface 130. These cam stops function to hold the ends 136 of the spring 126 which are substantially straight, extend radially outwardly, and preferably lie in horizontal planes. Cam stop 132 includes a ramp surface 138 extending away from the undersurface 128, and further includes a retention surface 140 extending intermediate underface 128 and the ramp surface. The retention surface at least partially underlies other components of the cam stop 132. The lower cam stop 134 similarly includes a ramp surface 138 and a retention surface 140. Each cam stop is spaced outwardly from the hub 118 so that a last turn of the spring 126 can be received therebetween.

Figure 7:
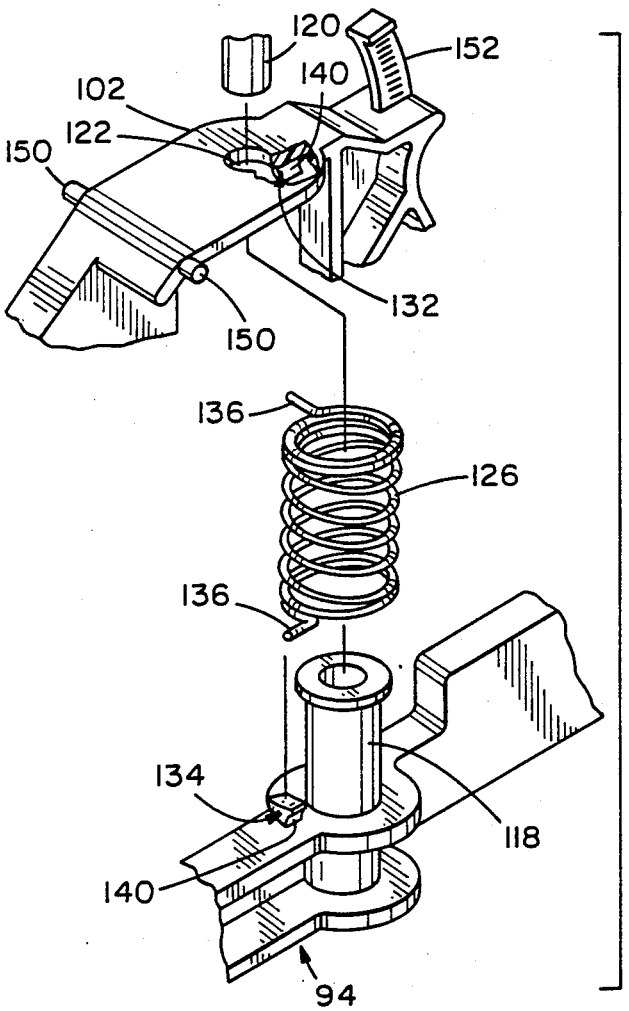
FIG. 7 is an exploded perspective drawing illustrating portions of the main body and impulse arm and depicting mounting of the helical torsion spring with respect to those components.

Referring to FIG. 7, the retention surface 140 of the cam stops 132 and 134 are preferably diametrically opposed when the impulse arm 94 is in its rest position with the spoon 112 aligned with the nozzle 106. The upper spring end 136, in the unloaded condition of the spring, preferably leads the lower spring end by an angle between 60 and 120 degrees in the clockwise direction. The spring 126 is disposed around the hub 118 when the impulse arm is mounted on the main body. Thereafter the spring 126 is easily positioned by placing the lower spring end 136 against the retention surface 140 of the lower cam stop 134, and pushing the upper spring end 136 against the ramp surface 138 of the upper cam stop. Movement of the upper spring end past the end of the upper cam stop 132 permits it to be captured by the upper retention surface 140. Of course the mounting procedure can be reversed by first locating the upper spring arm against the upper cam stop 132 and then moving the lower spring end against the ramp surface of the lower cam stop 134. It will be appreciated that the spring 126 can be positioned either without tools or using only a simple tool, such as a screwdriver, and there is no need for centering lugs on the impulse arm or on the top wall of the frame.

Figure 8:
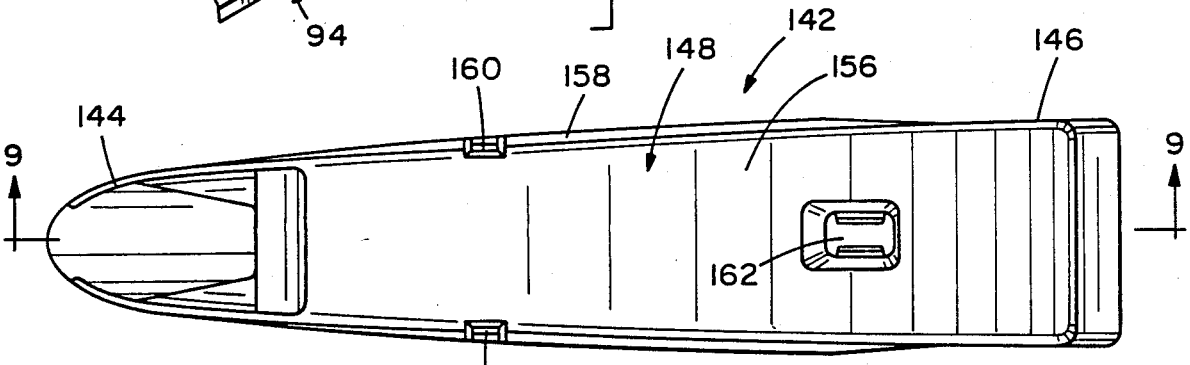
FIG. 8 is a plan view of the deflector.
Figure 9:
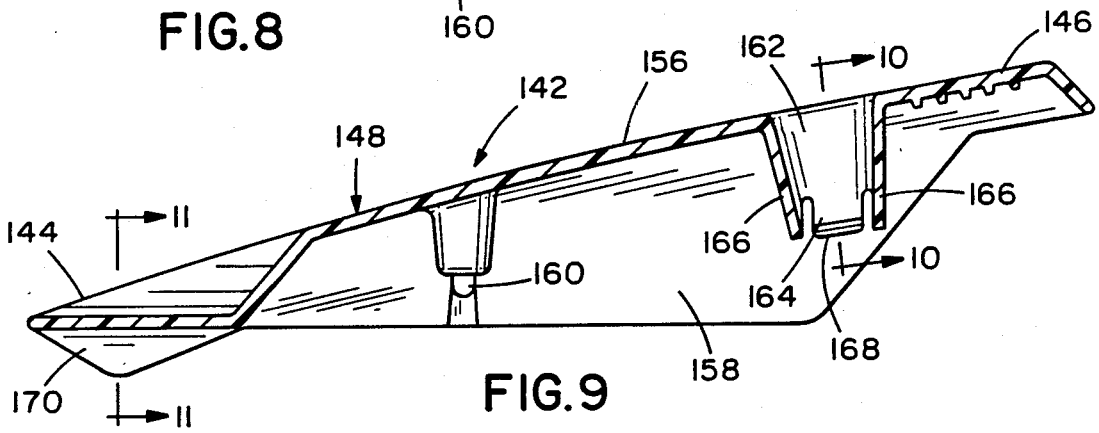
FIG. 9 is a sectional view of the deflector taken generally along line 9—9 of FIG. 8.

The impulse sprinkler 20 also comprises an elongate deflector 142 pivotally carried by the main body 30 so that the deflector is rotatable about a horizontal axis. The deflector 142, best shown in FIGS. 8 and 9, is of one-piece molded thermoplastic construction and includes a deflector head 144 for overlying the nozzle 106, a tail position 146 for grasping by the user, and an intermediate portion 148 supported by the main body 30. The deflector is pivotable on the main body through a range of positions between a maximum deflection position in which the deflector head 144 is adjacent the nozzle 106, and a minimum deflection position in which the head is remote from the nozzle to permit maximum radial excursion of water dispensed by the nozzle.

More specifically, the top wall 102 of the main body 30 includes a pair of opposite extending lugs 150, and further includes an upwardly extending arcuate post 152 having a plurality of regularly vertically spaced generally horizontal ribs 154 on each of its longitudinally extending outer surfaces, as best shown in FIG. 3. Referring again to FIGS. 8 and 9, the intermediate portion includes an upper wall 156 and a pair of spaced side walls 158 dependent from the upper wall and diverging downwardly. The side walls are spaced sufficiently to receive the frame top wall 102 and each side wall 158 has an opening 160 for receiving one of the lugs 150 thereby pivotally mounting the deflector.

Figure 10:
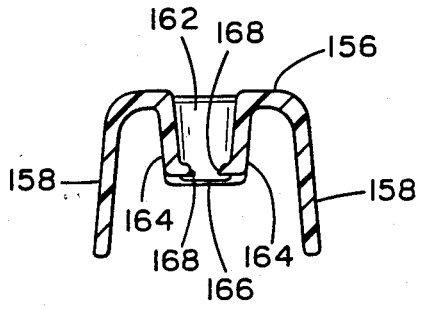
FIG. 10 is a sectional view taken generally along line 10—10 of FIG. 9.

The upper wall 156 further includes an opening 162, defined by a pair of longitudinally extending interior arms 164 and a pair of transversely extending interior walls 166. The opening 162 receives the post 152 and each arm 164 has an inwardly directed, deflectable lip 168, as best shown in FIG. 10, for receiving the post in an interface fit. The lips 168 cooperate with the post ribs 154 to hold the deflector in one of its positions.

Figure 11:
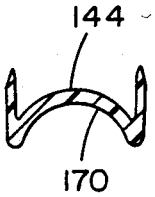
FIG. 11 is a sectional view taken generally along line 11—11 of FIG. 9.

Referring to FIG. 11, the deflector head 144 includes a concave undersurface 170 for impingement by water dispensed by the nozzle 106. While the deflector functions to limit the radial distance traveled by the water, the concave surface 170 concentrates the stream to preclude overspray.

Operation of the deflector 142 is as follows. In order to adjust the deflector to increase or decrease the radial excursion of the dispensed water, the operator need only grasp the tail portion 146. By pushing the tail portion down, the deflector 142 pivots about the lugs 150 causes the deflector head 144 to raise, thereby permitting the water to travel further outwardly. The minimum deflection position is defined at the point at which the bottoms of the walls 166 contact the upper surface of the top wall 102. On the other hand, to decrease the distance the water is sprayed, the operator need only raise the tail portion 146 to cause the deflector head 144 to drop closer to the nozzle 106. The maximum deflection position occurs when the top wall 102 of the frame is contacted by the side walls 158 of the intermediate portion 148 of the deflector 142.

It will be appreciated that the adjustment of the deflector can be simply effected using only one hand. Additionally the deflector of the present invention is of one-piece construction and can easily be mounted on the impulse head.

In view of the above, it will be seen that the several objects of the invention are achieved and other advantageous results attained.

As various changes could be made in the above construction without departing from the scope of the invention it is intended that all matter contained in the above description or shown in the accompanying drawings shall be interpreted as illustrative and not in a limiting sense.

What is claimed is:

1. An impulse sprinkler for step-by-step watering and capable of part-circle operation, said sprinkler comprising:

a base;

a main body including a nozzle for dispensing water and a frame defining a window, said frame including a top wall;

means pivotally mounting said main body on said base enabling said main body to rotate about a substantially vertical axis;

an impulse arm for deflection by water dispensed by said nozzle;

means pivotally mounting said arm on said main body so that said arm extends through said window and is rotatable about said substantially vertical axis;

spring means disposed in said window for biasing said impulse arm to a position wherein it will be deflected by water from said nozzle;

and an elongate deflector pivotally carried by said main body so that said deflector is rotatable about a substantially horizontal axis, said deflector being of one-piece molded thermoplastic construction and including a deflector head overlying said nozzle, a tail portion for grasping by the user, and an intermediate portion supported by said main body, said deflector being pivotable through a range of positions between a maximum deflection position in which said head is adjacent said nozzle and a minimum deflection position in which said head is remote from said nozzle, said main body and said intermediate portion together comprising holding means for holding said deflector in a predetermined one of said positions, said holding means comprising a post extending upwardly from said top wall, said holding means further comprising an opening in said intermediate portion receiving said post, said intermediate portion including an upper wall with a pair of spaced interior arms, dependent from said upper wall, defining said opening and receiving said post in an interference fit.

2. An impulse sprinkler as set forth in claim 1 wherein the outside surface of said post has a series of vertically spaced ridges corresponding to the positions of said deflector, at least one of said interior arms having at least one lip on its inside surface for cooperating with said ridges to hold said deflector in a predetermined position.

3. An impulse sprinkler as set forth in claim 1 wherein said deflector head has an undersurface for impingement by water from said nozzle, said undersurface being concave.

4. An impulse sprinkler as set forth in claim 1 wherein said intermediate portion includes a pair of spaced side walls dependent from said upper wall and spaced sufficiently to receive the top wall of said main body, said top wall including a pair of oppositely outwardly extending lugs and each side wall having an aligned aperture for receiving a lug to pivotally mount said deflector on said body.

5. An elongate deflector for mounting on the main body of an impulse sprinkler to limit the radial distance of travel of water dispensed by the nozzle of said sprinkler, said deflector being of one-piece molded thermoplastic construction and comprising:

a head for overlying said nozzle and including an arcuate undersurface for impingement of the water;

a tail for grasping by the user; and an intermediate portion joining said head and tail, said intermediate portion including an upper wall and a pair of spaced sidewalls which include means for pivotally mounting said deflector on said main body so that said deflector can rotate about a horizontal axis through a number of positions between a maximum deflection position in which said head is adjacent said nozzle and a minimum deflection position in which said head is remote from said nozzle, said intermediate portion further including a pair of arms dependent from said upper wall and spaced to receive a component extending upwardly from said main body in an interference fit to hold said deflector in a predetermined one of said positions.

* * * * *

UNITED STATES PATENT AND TRADEMARK OFFICE

CERTIFICATE OF CORRECTION

PATENT NO. : 4,907,742

DATED : March 13, 1990

INVENTOR(S) : Stephen P. Whitehead et al.

It is certified that error appears in the above-identified patent and that said Letters Patent is hereby corrected as shown below:

Column 3, line 26, change "50" to --60--.

Column 3, line 31, change "65" to --68--.

Signed and Sealed this

Sixteenth Day of April, 1991

*Attest:*

HARRY F. MANBECK, JR.

*Attesting Officer*

*Commissioner of Patents and Trademarks*